United States Patent [19]

Hamaker

[11] 4,119,308

[45] Oct. 10, 1978

[54] SHEET STRIPPING APPARATUS

[75] Inventor: Ralph A. Hamaker, Penfield, N.Y.

[73] Assignee: Xerox Corporation, Stamford, Conn.

[21] Appl. No.: 807,956

[22] Filed: Jun. 20, 1977

[51] Int. Cl.[2] ..... B65H 29/54

[52] U.S. Cl. ..... 271/174; 271/DIG. 2

[58] Field of Search ..... 271/174, DIG. 2, 260

[56] References Cited

U.S. PATENT DOCUMENTS

| | | | |
|---|---|---|---|
| 3,300,114 | 1/1967 | Jacobsen | 226/180 |
| 3,891,206 | 6/1975 | Bar-On | 271/174 |

*Primary Examiner*—Richard A. Schacher

*Attorney, Agent, or Firm*—J. J. Ralabate; C. A. Green; H. Fleischer

[57] ABSTRACT

An apparatus in which a sheet is separated from a moving member. The apparatus includes a pair of elastomeric diaphragms coupled to a stripping member. A detector senses the spacing between the moving member and the stripping element of the stripping member. The diaphragms, in response to the sensed spacing, pivot the stripping member so as to maintain the space between the moving member and stripping element substantially constant.

4 Claims, 3 Drawing Figures

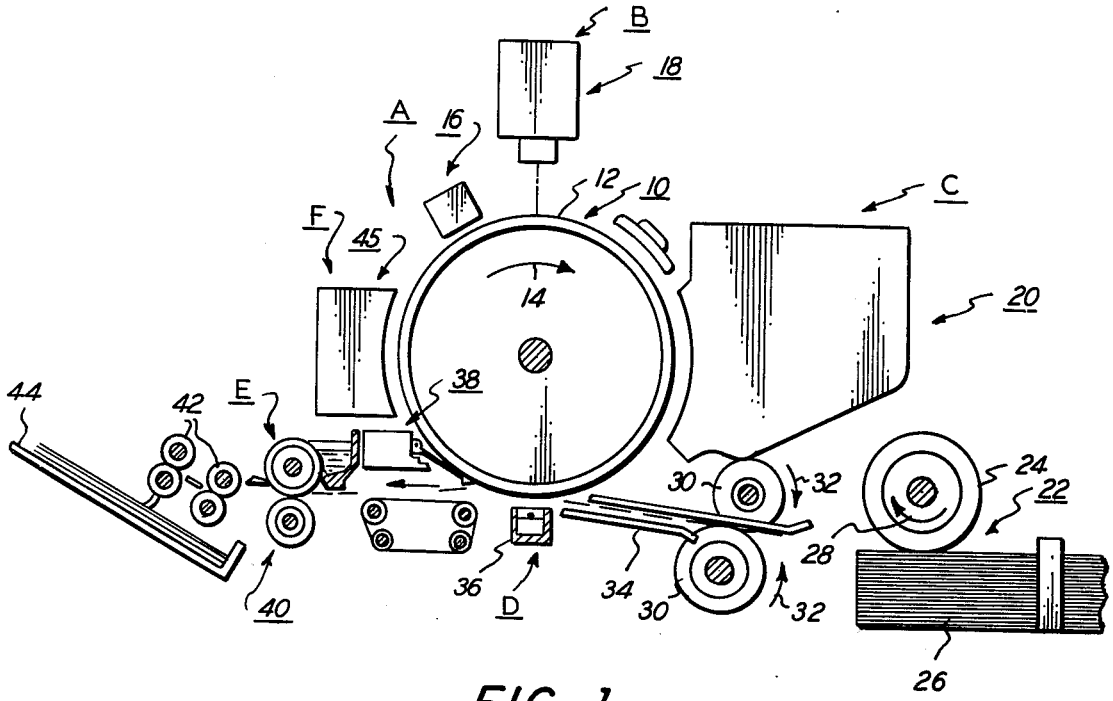
FIG. 1
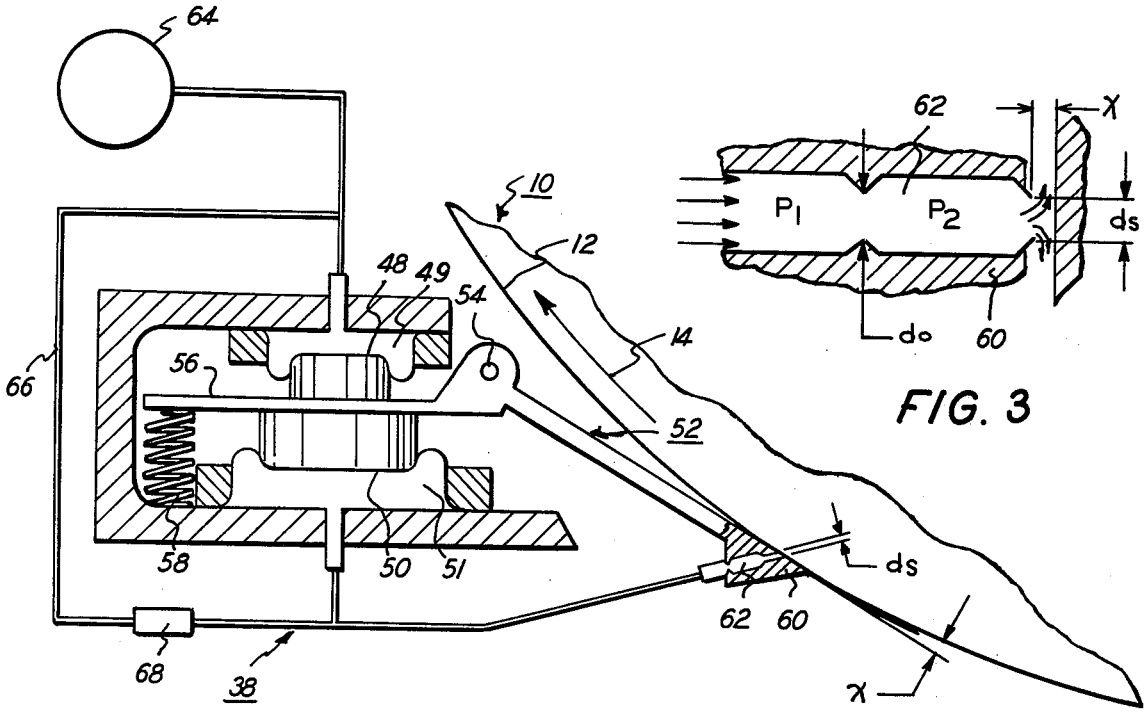
FIG. 2
FIG. 3

SHEET STRIPPING APPARATUS

The foregoing abstract is neither intended to define the invention disclosed in the specification nor is it intended to be limiting as to the scope of the invention in any way.

BACKGROUND OF THE INVENTION

This invention relates generally to an electrophotographic printing machine, and more particularly concerns an apparatus for separating copy sheets having a toner powder image transferred thereto from a moving photoconductive surface.

In the process of electrophotographic printing, a charged photoconductive member is exposed to a light image of an original document being reproduced. The irradiated areas of the photoconductive surface are discharged to record thereon an electrostatic latent image corresponding to the informational areas contained within the original document. A development system moves a developer mix of carrier granules and toner particles into contact with the photoconductive surface. The toner particles are attracted electrostatically from the carrier granules to the latent image forming a toner powder image thereon. Thereafter, the toner powder image is transferred to a sheet of support material. After transferring the toner powder image to the sheet of support material, a fusing device permanently affixes the toner powder image thereto.

During the transfer process, the sheet of support material is generally placed in contact with the toner powder image on the photoconductive surface and the backside of the sheet subjected to a spray of ionized air. This results in a charge being formed on the sheet having a magnitude and polarity sufficient to electrostatically attract the toner particles thereto. However, during transfer, a charge opposite to the charge found in the non-image areas of the photoconductive surface is induced on the sheet of support material. This causes the sheet to become electrostatically tacked to the photoconductive surface. The removal of the sheet of support material from the photoconductive surface has long been a problem in electrophotographic printing. Mechanical and pneumatic stripping devices have been used for quite some time in the printing art with varying degrees of success. However, devices of this type frequently suffer from misalignment problems. When the stripping mechanism is misaligned, it fails to act upon the sheet of support material either at the proper time or at the proper place. The sheet of support material may then remain on the photoconductive surface, i.e. it is not stripped, or the toner powder image is marred. In the case of a mechanical stripper wherein the pick off fingers are interposed between the photoconductive surface and the sheet of support material, misalignment of the fingers may produce abrasion or scratches on the photoconductive surface necessitating replacement thereof. Any of these malfunctions can seriously impair the reliability of the printing machine involving a great deal of lost machine time and, in the extreme case, result in permanent damage to the machine components. To this end, devices have been developed for floating the stripper finger on a cushion of air. This requires that the stripping fingers be spaced at a substantially constant distance from the photoconductive surface. However, a rotating photoconductive drum frequently has run-out which causes variations in the spacing between the stripping fingers and the photoconductive surface. To overcome this problem, the stripping finger has to be mounted movably. Hereinbefore, pneumatic devices, such as bellows, controlled the movement of the stripping fingers. Systems of this type generally have high spring constants requiring a large volume control chamber. This may result in a slow system response time causing errors which may result in mis-stripping.

Accordingly, it is a primary object of the present invention to improve the sheet stripping apparatus employed in an electrophotographic printing machine.

PRIOR ART STATEMENT

Various types of devices have hereinbefore been developed to improve the sheet stripping system. The following prior art appears to be relevant:

Stange, U.S. Pat. No. 3,804,401, 4/16/74
Norton et al., U.S. Pat. No. 3,837,640, 9/24/74
Bar-on, U.S. Pat. No. 3,891,206, 6/24/75
Martin, U.S. Pat. No. 3,992,000 11/16/76

The pertinent portions of the foregoing prior art may be briefly summarized as follows:

Stange discloses a stripping member having a wedge shaped stripping element positioned adjacent to the drum surface to affect separation of the paper from the drum surface. The stripping member is supported by a gimballed spring which holds the wedge shaped stripping element against the photoconductive surface. A manifold is connected to an air supply which furnishes low pressure air to the stripping element. This produces an air cushion on the bottom of the stripping element to float it. The action of the spring is opposed to the action of the air pressure. In this manner, the striping element pivots conforming to the irregularities in the drum surface.

Norton et al. describes a stripping finger supported on an air cushion. The air cushion supports the stripping finger at a uniform distance from the drum surface due to the action of springs. The springs urge the stripper finger upwardly into contact with the drum surface. Movement of the finger normal to the drum is effected by pivoting. The tip portion of the stripping finger member extends slightly beyond the point of tangency of the drum surface. In this manner, the tip strips the leading edge of the sheet from the drum surface.

Bar-on describes an automatically positionable sheet stripping finger which removes individual sheets from a moving photosensitive plate. The stripping finger is supported upon a pivotable arm provided with a pneumatic sensing nozzle. The nozzle senses variations in the pressure between the stripping finger and photosensitive surface. The nozzle, in turn, is connected to an amplifier which is arranged to control the positioning of the arm in response to the back pressure developed at the nozzle. As the stripper finger moves toward or away from the photoconductive surface, the back pressure changes causing the amplifier to move the arm in a direction so as to restore the stripping finger to the desired sheet stripping position.

Martin discloses a stripping element having bearing surfaces at the leading and trailing ends thereof. The stripping element is mounted pivotably being resiliently urged toward the surface of the photoreceptor.

It is believed that the scope of the present application, as defined by the appended claims, is patentably distinguishable over the foregoing prior art taken either singly or in combination with one another.

SUMMARY OF THE INVENTION

Briefly stated and in accordance with the present invention, there is provided an apparatus for separating a sheet from a moving member.

Pursuant to the features of the invention, the apparatus includes a stripping member mounted pivotably on a support member. The stripping member has a stripping element spaced closely adjacent to the moving member and arranged to be interposed between the moving member and sheet. Means are provided for detecting the spacing between the stripping element of the stripping member and the moving member. A pair of elastomeric diaphragms, coupled to the stripping member, are in communication with the detecting means. The diaphragms pivot the stripping member in response to the detected spacing between the stripping element and the moving member. In this manner, the spacing between the moving member and the stripping element is maintained substantially constant.

BRIEF DESCRIPTION OF THE DRAWINGS

Other objects and advantages of the present invention will become apparent upon reading the following detailed description and upon reference to the drawings, in which:

FIG. 1 is a schematic elevational view illustrating an electrophotographic printing machine incorporating the features of the present invention therein;

FIG. 2 is a schematic elevational view depicting the sheet stripping apparatus employed in the FIG. 1 printing machine; and FIG. 3 is a fragmentary, sectional elevational view showing the air passageway in the stripping element of the FIG. 2 stripping apparatus.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of an electrophotographic printing machine in which the features of the present invention may be incorporated, reference is had to FIG. 1 which depicts schematically the various components thereof. Hereinafter, like reference numerals will be employed throughout to designate identical elements. Although the apparatus for separating the sheet of support material from the photoconductive surface after transferring the toner powder image thereto is particularly well adapted for use in electrophotographic printing, it should become evident from the following discussion that it is equally well suited for use in a wide variety of devices and is not necessarily limited in its application to the particular embodiment shown herein.

Inasmuch as the practice of electrophotographic printing is well known in the art, the various processing stations for producing a copy of an original document are represented in FIG. 1 schematically. Each processing station will be discussed briefly hereinafter.

As in all electrophotographic systems of the type illustrated, a drum 10 having a photoconductive surface 12 entrained about and secured to the exterior circumferential surface of a conductive substrate is rotated, in the direction of arrow 14, through the various processing stations. One type of suitable photoconductive material is described in U.S. Pat. No. 2,970,906 issued to Bixby in 1961. Preferably, the conductive substrate is made from aluminum.

Initially, drum 10 rotates a portion of photoconductive surface 12 through charging station A. Preferably, charging station A utilizes a corona generating device, indicated generally by the reference numeral 16, to sensitize photoconductive surface 12. Corona generating device 16 is positioned closely adjacent to photoconductive surface 12. When energized, corona generating device 16 charges at least a portion of photoconductive surface 12 to a relatively high substantially uniform potential. For example, corona generating device 16 may be of the type described in U.S. Pat. No. 2,836,725 issued to Vyverberg in 1958.

Thereafter, drum 10 rotates the charged portion of photoconductive surface 12 to exposure station B. Exposure station B includes an exposure mechanism, indicated generally by the reference numeral 18, having a stationary, transparent platen, such as a glass plate or the like, for supporting an original document thereon. Scan lamps illuminate the original document. Scanning of the original document may be achieved by oscillating a mirror in a timed relationship with the movement of drum 10. This mirror is positioned beneath the platen to reflect the light image of the original document through a lens onto a mirror, which, in turn, transmits the light image through an apertured slit onto the charged portion of photoconductive surface 12. Irradiating the charged portion of photoconductive surface 12 selectively discharges the charge thereon to record an electrostatic latent image corresponding to the informational areas contained within the original document.

Drum 10 next rotates the electrostatic latent image recorded on photoconductive surface 12 to development station C. Development station C includes a developer unit, indicated generally by the reference numeral 20, having a housing with a supply of developer mix contained therein. The developer mix comprises carrier granules having toner particles adhering triboelectrically thereto. The carrier granules are preferably formed from a magnetic material with the toner particles being formed from a heat-settable plastic. Preferably, developer unit 20 is a magnetic brush development system. In a system of this type, the developer mix is brought through a directional flux field to form a brush thereof. The electrostatic latent image recorded on photoconductive surface 12 is developed by bringing the brush of developer mix into contact therewith. In this manner, the toner particles are attracted electrostatically to the latent image forming a toner powder image on photoconductive surface 12.

With continued reference to FIG. 1, a sheet of support material is advanced by sheet feeding apparatus 22 to transfer station D. Sheet feeding apparatus 22 includes a feed roll 24 contacting the uppermost sheet of the stack of sheets of support material 26. Feed roll 24 rotates in the direction of arrow 28 so as to advance the uppermost sheet from stack 26. Registration rollers 30, rotating in the direction of arrow 32, align and forward the advancing sheet of support material into chute 34. Chute 34 directs the advancing sheet of support material into contact with drum 10 in a timed sequence so that the toner powder image developed thereon contacts the advancing sheet of support material at transfer station D.

At transfer station D, corona generating device 36 applies a spray of ions to the backside of the sheet of support material. This attracts the toner powder image from photoconductive surface 12 to the sheet of support material. However, in addition, it frequently tacks the sheet of support material to drum 10. Thus, during the step of transfer, the sheet of support material becomes electrostatically tacked to drum 10. In order to advance the sheet with the toner powder image thereon to the fusing station, it must be separated from drum 10. This is achieved by sheet stripping apparatus 38. Sheet stripping apparatus 38 will be described hereinafter more fully with reference to FIGS. 2 and 3.

After transferring the toner powder image to the sheet of support material and separating the sheet of support material from drum 10, the sheet of support material is advanced to a fusing station E. Fusing station E includes a fuser assembly, indicated generally by the reference numeral 40. Fuser assembly 40 permanently affixes the transferred toner powder image to the sheet of support material. After the toner powder image is permanently affixed to the sheet of support material, the sheet of support material is advanced by a series of rollers 42 to catch tray 44 for subsequent removal therefrom by the machine operator.

Invariably, after the sheet of support material is stripped from photoconductive surface 12 of drum 10, some residual toner particles remain adhering to photoconductive surface 12. These residual toner particles are removed from photoconductive surface 12 at cleaning station F. Cleaning station F includes a cleaning system, indicated generally by the reference numeral 45. Initially, toner particles are brought under the influence of the cleaning system's corona generating device (not shown). The corona generating device neutralizes the remaining electrostatic charge on photoconductive surface 12 and that of the residual toner particles. The neutralized toner particles are cleaned from photoconductive surface 12 by a rotatably mounted fibrous brush in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts sheet stripping apparatus 38 in greater detail.

As shown in FIG. 2, stripping assembly 38 includes a housing 46 mounted on the machine frame. Housing 46 is U-shaped and has a pair of diaphragms 48 and 50 interposed between opposed legs thereof. Stripping member 52 is supported pivotably by pin 54 attached fixedly to housing 46. The tail portion 56 of stripping member 52 is interposed between and secured to diaphragms 48 and 50. A helical coil spring 58 has one end portion thereof connected to tail portion 56 and the other end portion thereof connected to housing 46. Stripping element 60 of stripping member 52 is disposed closely adjacent to photoconductive surface 12 of drum 10. The surface of stripping element 60 opposed to photoconductive surface 12 is spaced a substantially constant distance therefrom. Inasmuch as drum 10 has run-out, stripping element 60 must move to maintain the spacing between the surface thereof opposed to photoconductive surface 12 and photoconductive surface 12 substantially constant. Spring 50 resiliently urges stripping member 52 to pivot about pin 54 spacing the surface of stripping element 60 opposed to photoconductive surface 12 at a nominal distance therefrom. Variations in this nominal spacing are detected and diaphragms 48 and 50 pivot stripping member 52 so as to compensate for any spacing changes.

A sensing nozzle 62 is provided within the relatively wider main body of stripping element 60 with the nozzle orifice facing photoconductive surface 12 just above the sheet pick-off region. The nozzle is connected to compressor 64 via line 66. Line 66 is also connected to diaphragms 48 and 50. The mass flow rate of air or gas is controlled by nozzle 62 and the spacing of the lowermost portion of surface of stripping element 62 from photoconductive surface 12. As drum 10 rotates, the run-out thereof causes the spacing between photoconductive surface 12 and the surface of stripping element 60 opposed therefrom to vary. As this space increases, the air flow causes a pressure drop across restrictor 68 and in nozzle 62. This decrease in pressure reduces the air pressure in chamber 51 causing diaphragms 50 to contract. This pivots stripping member 52 toward photoconductive surface 12 so as to maintain the spacing between photoconductive surface 12 and the stripping element 60 substantially constant. Contrawise, if the distance between stripping element 60 and photoconductive surface 12 decreases, the pressure in chamber 51 increases causing diaphragm 50 to expand. This results in stripping member 52 pivoting away from photoconductive surface 12. Stripping member 52 pivots sufficiently to return the surface of stripping element 60 opposed from photoconductive surface 12 to substantially the original spacing, i.e. a pre-determined distance or spacing from photoconductive surface 12 within an allowable error band. In this manner, the spacing between the stripping element 60 and photoconductive surface 12 is maintained substantially constant. It should be noted that the pressure in chamber 49 remains substantially constant while the pressure in chamber 51 is variable depending upon the spacing between the stripping element 50 and photoconductive surface 12. Restrictor 68 acts as a resistance to air flow and causes the varying pressures in chamber 51 as affected by the change in spacing between photoconductive surface 12 and stripping element 60. Compressor 64 furnishes air at a pressure preferably of about 15 psi and at a flow rate preferably of about 0.03 cubic feet per minute. Thus, movement of stripping member 52 from the nominal position toward or away from photoconductive surface 12 causes the pressure in nozzle 62 to vary. This, in turn, increases or decreases the pressure within chamber 51. Inasmuch as the pressure within chamber 49 remains substantially constant, the change in pressure in chamber 51 pivots stripping member 52 about pin 54 so as to balance the forces exerted by diaphragms 48 and 50. In this way, the spacing between photoconductive surface 12 and stripping element 60 is substantially constant when the forces of diaphragms 48 and 50 are in balance with one another. Preferably, diaphragms 48 and 50 are made from an elastomeric material having a low spring constant. This insures a narrow steady state error band within which stripping member 52 must operate in detecting spacing changes. Moreover, this enables the system to employ low volume chambers within each of the diaphragms. By way of example, diaphragms 48 and 50 are preferably made from rubber, such as are manufactured by the Bellofram Corporation of Burlington, Mass.

In operation, stripping element 60 is supported at a pre-selected distance from photoconductive surface 12 within a range of about one-half the thickness of the sheet of support material. Stripping element 60 is maintained at a substantial uniform distance from photoconductive surface 12, i.e. within an allowable error band, due to the actions of diaphragms 48 and 50 in pivoting stripping member 52 about pin 54 so that their forces always tend to be in equalibrium with one another. The desire for the diaphragms to always return to an equalibrium situation maintains the spacing between stripping element 60 and photoconductive surface 12 substantially constant. The tip portion of stripping element 60 is substantially located at the point of tangency of photoconductive surface 12. In this manner, the tip strips the leading edge of the sheet of support material from photoconductive surface 12.

It will be appreciated that stripping element 60 does not contact photoconductive surface 12 during the stripping operation, but is held therefrom at a preselected distance, within an allowable error band. In this manner, stripping element 60 will not damage or otherwise abrade photoconductive surface 12.

Turning now to FIG. 3, there is shown the detailed structure of nozzle 62. As depicted therein, the spacing between stripping element 60 and photoconductive surface 12 is designated by X. As X increases, the air flow causes a pressure drop across $d_0$ and reduces the pressure $P_2$ in the control chamber of nozzle 62. The pressure $P_2$ in nozzle 62 corresponds to the pressure in chamber 51. Contrawise, the pressure $P_1$ in nozzle 62 corresponds to the pressure in chamber 49 50 and remains substantially constant. The decrease in pressure $P_2$ reduces the upward force exerted by diaphragm 50. Inasmuch as the force exerted by diaphragm 48 is now greater than the force exerted by diaphragm 50, stripping member 52 pivots about pin 54 moving stripping element 60 toward photoconductive surface 12. This reduces the air flow and increases the pressure $P_2$ to restore diaphragm 50 and 48 to an equalibrium condition. This back and forth motion of photoconductive surface 12 due to the run-out of drum 10 varies the pressure $P_2$ pivoting stripping member 52 so as to maintain the spacing between stripping element 60 and photoconductive surface 12 substantially constant.

As has hereinbefore been shown, this stripping system provides a self-regulating arrangement which will continually position stripping element 60 at a substantially constant distance relative to photoconductive surface 12 regardless of drum run-out or other eccentricities that may be established between the two coacting surfaces. The required change in distance is sensed by nozzle 62. In response thereto, diaphragms 48 and 50 pivot stripping member 52 to maintain the spacing between stripping element 60 and photoconductive surface 12 substantially constant.

In recapitulation, it is apparent that pursuant to the features of the present invention, as heretofore described, the stripping apparatus pivots so as to maintain the stripping element thereof at a pre-selected substantially constant distance from photoconductive surface 12. The system response time is rapid so as to correct for any drum run-out conditions. The foregoing is achieved by a pair of elastomeric diaphragms coacting with one another to pivot the stripping member relative to the photoconductive surface.

It is, therefore, evident that there has been provided, in accordance with the present invention, an apparatus for separating sheets of support material electrostatically tacked to a photoconductive surface. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for separating a sheet from a moving member, including:

a support member;

a stripping member mounted pivotably on said support member, said stripping member comprising a stripping element spaced closely adjacent to the moving member and arranged to be interposed between the moving member and sheet with the stripping element having a passageway terminating in an aperture in the surface thereof opposed to the moving member;

means for detecting the spacing between the stripping element of said stripping member and the moving member, said detecting means comprises means for supplying a pressurized gas to the passageway in the stripping element of said stripping member with the passageway being configured to provide pressure changes in response to variations in the spacing between the moving member and the stripping element of said stripping member;

means for resiliently urging the stripping element of said stripping member to a nominal position; and a pair of diaphragms coupled to said stripping member and in communication with said detecting means, said pair of diaphragms pivoting said stripping member in response to the detected spacing between the stripping element of said stripping member and the moving member to maintain the spacing therebetween substantially constant, said pair of diaphragms being made preferably from an elastomeric material having a low spring constant with the pressure in one of said pair of diaphragms remaining substantially constant while the pressure in the other of said pair of diaphragms varies in accordance with the changes in pressure in the passageway of the stripping element of said stripping member.

2. An apparatus as recited in claim 1, wherein said pair of diaphragms are made preferably from rubber.

3. An electrophotographic printing machine of the type having a sheet of support material electrostatically tacked to a movable photoconductive member during the transfer of a toner powder image from the photoconductive member to the sheet of support material, wherein the improvement includes:

a stripping member mounted pivotably on the printing machine, said stripping member comprising a stripping element spaced closely adjacent to the photoconductive member and arranged to be interposed between the photoconductive member and sheet of support material with the stripping element having a passageway terminating in an aperture in the surface thereof opposed to the photoconductive member;

means for detecting the spacing between the stripping element of said stripping member and the photoconductive member, said detecting means comprises means for supplying a pressurized gas to the passageway in the stripping element of said stripping member with the passageway being configured to produce pressure changes in response to variations in the spacing between the photoconductive member and the stripping element of said stripping member;

means for resiliently urging the stripping element of said stripping member to a nominal position; and a pair of diaphragms coupled to said stripping member and in communication with said detecting means, said pair of diaphragms pivoting said stripping member in response to the detected spacing between the stripping element of said stripping member and the photoconductive member to maintain the spacing therebetween substantially constant, said pair of diaphragms being made preferably from an elastomeric material having a low spring constant with the pressure in one of said pair of diaphragms remaining substantially constant while the pressure in the other of said pair of diaphragms varies in accordance with the changes in pressure in the passageway of the stripping element of said stripping member.

4. A printing machine as recited in claim 3, wherein said pair of diaphragms are made preferably from rubber.

* * * * *